United States Patent [19]

Maguire

[11] 4,197,601

[45] Apr. 15, 1980

[54] SLEEPING BAG CONSTRUCTION

[76] Inventor: Sara B. Maguire, 1952 Port Provence Pl., Newport Beach, Calif. 92660

[21] Appl. No.: 848,238

[22] Filed: Nov. 3, 1977

[51] Int. Cl.[2] ..... A47G 9/00

[52] U.S. Cl. ..... 5/416; 2/69.5; 5/497; 5/419

[58] Field of Search ..... 5/343, 344, 344 R, 351, 5/416, 419, 974, 485, 497, 498; 2/69.5

[56] References Cited

U.S. PATENT DOCUMENTS

| | | | |
|---|---|---|---|
| 2,918,683 | 12/1959 | Kaplan | 5/343 |
| 3,173,159 | 3/1965 | Hart | 5/351 |
| 3,579,675 | 2/1970 | Scheer | 5/344 |
| 4,021,869 | 5/1977 | Root | 5/334 C |

*Primary Examiner*—Casmir A. Nunberg
*Attorney, Agent, or Firm*—Ben E. Lofstedt

[57] ABSTRACT

An improved sleeping bag construction having an expandable pillow pocket at the head thereof, a bag portion extending along less than one-half the length of the sleeping bag, the upper portion of which includes a pair of longitudinally arranged edges which extend substantially beyond the bottom portion of the bag, and a foot portion having a longitudinally extensible and laterally expandable section within the bag portion at the foot of the sleeping bag, the bag and pillow pocket characterized by large, radiused corners and being joined about the edge by piping strips.

7 Claims, 6 Drawing Figures

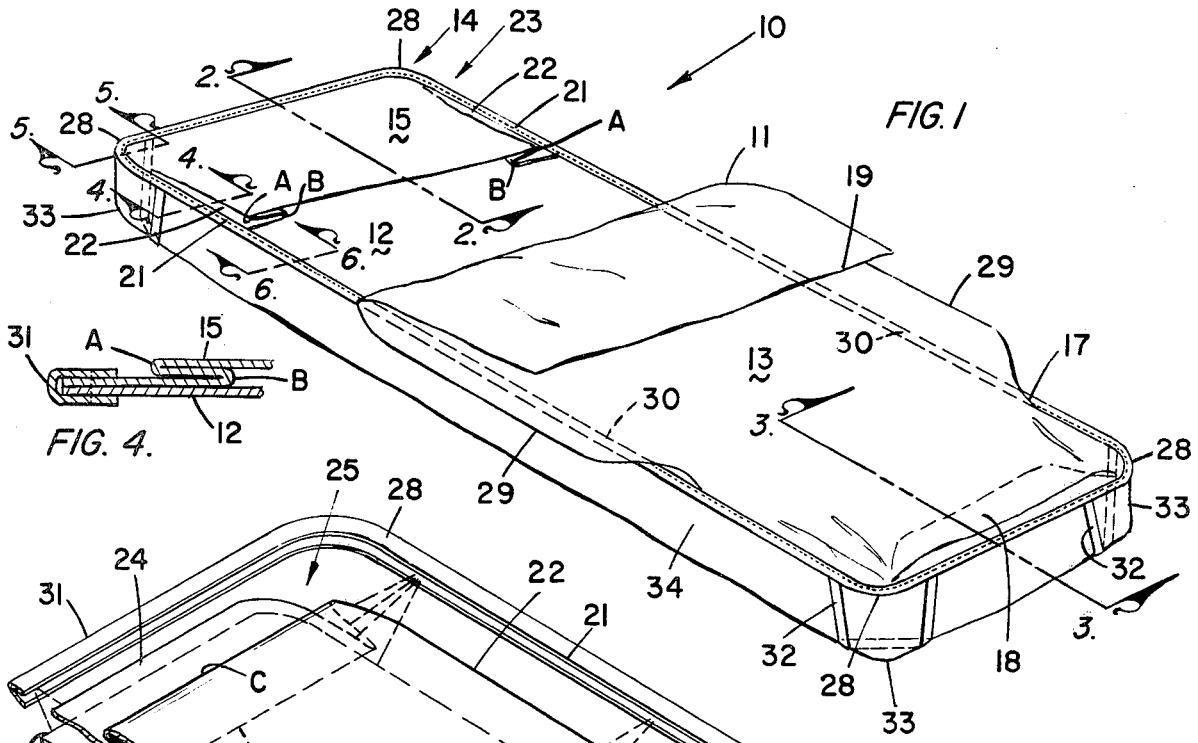
FIG. 1
FIG. 4.
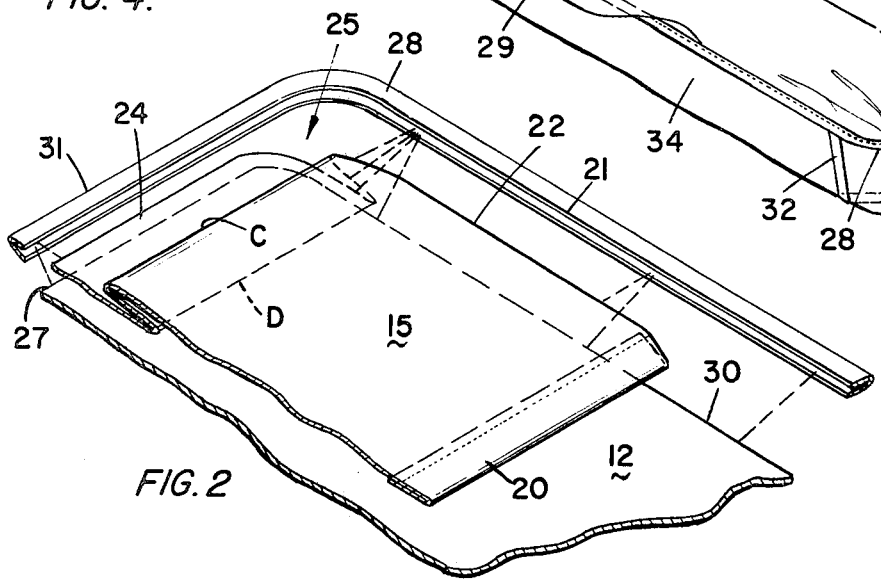
FIG. 2
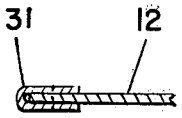
FIG. 6
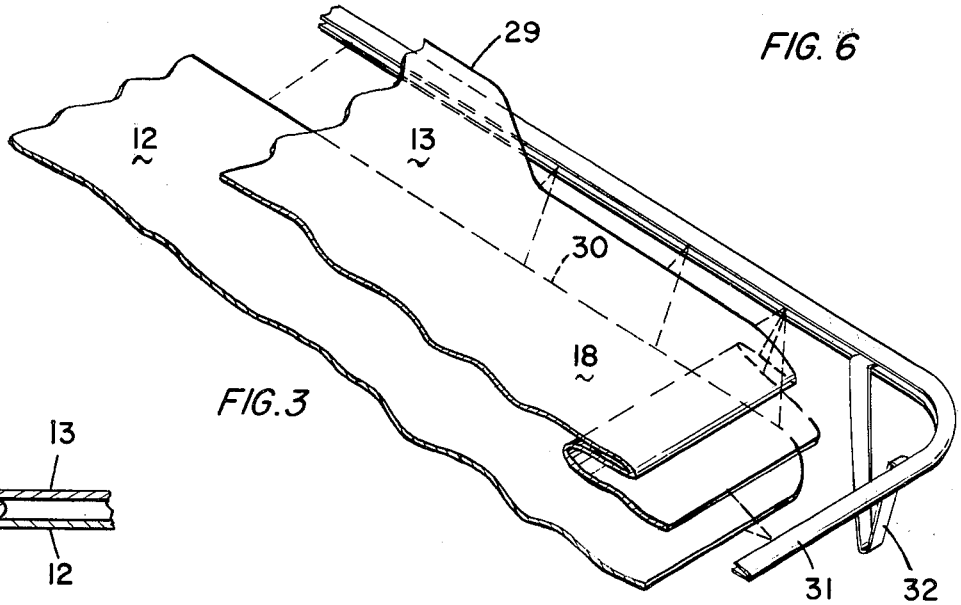
FIG. 3
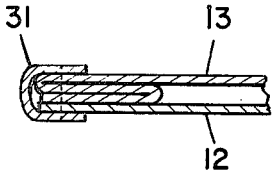
FIG. 5

SLEEPING BAG CONSTRUCTION

BACKGROUND OF THE INVENTION

1. Field of the Invention

The present invention relates to sleeping bags and the like, and more particularly, to a new and novel construction therefor for replacement of separate sheets and pillow cases employed in conjunction with a mattress.

2. Description of the Prior Art

Sleeping bags found in the prior art have been widely used in a number of various ways and in diverse applications.

One such application includes the use of such sleeping bags as taught by U.S. Pat. No. 2,239,017 (Roberts) wherein it is used as a sanitary covering for a bed having particular usefulness with babies or young children to keep them fully covered at all times.

As clearly identified by these sleeping bags, sanitation and convenience are important and desirable characteristics of such items.

One of the problems encountered with prior art sleeping bags is that the sanitary liner fails to include a means for also protecting the pillow in a similar sanitary fashion as the bed or sleeping bag.

Another difficulty frequently exhibited by sleeping bags of the prior art variety is that the bottom of the bag enclosing the feet of the user is uncomfortably confining to the user's feet and unduly restricts the movement thereof.

Anoher limitation experienced in the use of previous bags is that such bags fail to incorporate means whereby the length of the sleeping bag is extensible to permit the use by a relatively taller person.

Modernly, use of sleeping bags has found wide spread use in conjunction with various recreational vehicles, such as motor homes, trailers and the like. Prior art bags open only along one side of the bag to permit ingress and egress therefrom. When a sleeping bag is used on a bed or bunk in such a recreational vehicle, the bag may open along the wrong side of the bed such as the side of the bed facing the wall of the recreational vehicle. Or the bag, perhaps, has failed to incorporate means for removably securing or lashing the sleeping bag to the mattress of the bed upon which it rests.

Further, the construction of many sleeping bags in the prior art is relatively complex and, consequently, is labor intensive and costly to produce.

The simplest construction of a sleeping bag is merely to seam two coextensive sheets together along the foot of the bag. However, when the person crawls therebetween, the upper sheet is elevated, opening the sides of the bag and uncovering the user thereof. Additionally, the seams form right angles with each oher, which requires that the sewing machine operator stop sewing, reorient the sheets to be seamed and seam along another line. Such a procedure is time consuming and increases the cost of such an article of manufacture. Further, the securing of the stretch tapes diagonally across the underside of the corners required the operator to perform multiple passes to sufficiently anchor the ends of the tapes to the edges of the seamed sheets, all of which involved additional time and expense.

The inventor herein, after a considerable amount of time, research and experimentation, has devised a sleeping bag of the type characterized and described herein to overcome the significant disadvantages such as found in the use of these prior art sleeping bags.

SUMMARY OF THE INVENTION AND OBJECTS

The subject invention disclosed herein fundamentally comprises a sleeping bag constructed of a pair of rectangularly-shaped sheet materials, typically bed-sheet fabric. The foot of the bag is constructed to form an accordian fold at the extremity thereof to permit it to be longitudinally extensible to allow the length of the bag to comfortably accomodate a taller person and laterally expandable to loosely enclose the user's feet. A single sheet of material is further formed to include a top sheet portion and a bottom sheet portion. The top and bottom sheet portions are joined together along the side edges from the foot up to a point approximately 10–20 percent of the length of the sleeping bag to form a bag to house the lower legs and feet of the person using the bag and to permit rapid and unfettered ingress and egress from either side of the bag. The unseamed portion of the top sheet portion extends substantially beyond the edges of the bottom sheet portion to provide overlapping coverage of the person when the person is sandwiched inbetween the top and bottom sheet portions, thereby raising the top sheet portion.

The head of the sleeping bag is arranged transversely so that the transverse edge of the head faces the center of the sleeping bag. The sidewardly facing edges are folded in accordian fashion to permit upward expansibility of the upper portion of the head of the sleeping bag. These same sidewardly facing edges are seamed to the bottom sheet portion, thereby forming a pocket for a pillow.

Elastic tapes are joined along the adjacent sides of the bag and extend diagonally across each of the four corners of the underside of the bottom sheet portion of the sleeping bag to permit the sleeping bag to be removably secured about the corresponding four corners of a mattress.

Each of the corners of the sleeping bag has a large radius, thereby allowing the entire bag to be seamed without stopping the sewing machine to start another seam.

It is an important object of the present invention to provide a sleeping bag of the type herein characterized by simple construction.

Another important and primary object of the instant invention is to provide a sleeping bag with a means whereby the foot of the bag portion is longitudinally extensible to permit a taller person to comfortably use the sleeping bag.

A yet still further and basic object of the invention is to provide a sleeping bag having a laterally expandably foot portion to contain the feet of the user without uncomfortable confinement thereof.

It is yet a still further and important object of the present invention to provide a sleeping bag with longitudinally arranged openings for simple and convenient ingress and egree to the bag portions of the sleeping bag from either side of the sleeping bag.

It is a still further important and primary object of the present invention to provide a sleeping bag with a pocket at the head thereof for sanitarily housing a pillow.

Another important object of the present invention is to provide a means whereby when a person uses the bag the sides thereof remain covered.

These and other objects, features and many of the attendant advantages of this invention will be appreciated more readily as the subject invention becomes better understood by reference to the following detailed description, when considered in connection with the accompanying drawings, wherein like parts in each of the several figures are identified by the same reference character, and wherein:

BRIEF DESCRIPTION OF THE DRAWINGS

FIG. 1 is a perspective view of the invention.

FIG. 2 is an enlarged portion of the subject invention taken along Plane 2—2 of FIG. 1.

FIG. 3 is an enlarged broken out portion of the instant invention taken along Plane 3—3 of FIG. 1.

FIG. 4 is a section of the present invention taken along Plane 4—4 of FIG. 1.

FIG. 5 is a section of the invention taken along Plane 5—5 of FIG. 1.

FIG. 6 is a section of the instant invention taken along Plane 6—6 of FIG. 1.

DESCRIPTION OF THE PREFERRED EMBODIMENT

With continuing reference now to the drawings, and more particularly now to FIG. 1, the preferred embodiment of the sleeping bag of the present invention is generally indicated at 10 comprising a generally rectangularly-shaped, elongated unitary sheet 11 of flexibly-foldably fabric material having a base portion 12, a cover portion 13, and a head portion, generally indicated at 14. A similar, but relatively smaller and wider sheet 15 of foldable fabric material forms a pocket 16 for a pillow when seamed to the head portion 14. A bag portion 17 with an extensible and expandable foot portion is generally shown at 18.

With emphasis now on FIG. 1, it is clearly shown and illustrated that the bag portion 17 may be economically and conveniently constructed of a single, unitary sheet 11 of fabric. Users of this particular type of sleeping bag 10 prefer, for reasons of comfortable enclosure of the feet and convenience and ease of moving the foot or feet into and out from under the cover portion 13, that the bag portion 17 be seamed along the edges 30 only ten to twenty percent of the entire length of the base portion 12.

Nevertheless, it should be noted at this time, that the construction of the present invention should not in any way be limited to the use of a single unitary sheet of fabric. A plurality of sheets could, if desired, be utilized with equally acceptable results. Further, the present invention could also be fabricated of other foldably flexible materials other than the "fabric sheets" described herein, such as the envelope structure filled with Kapok or other yieldingly resilient material described in U.S. Pat. No. 2,,594,438.

The sheet 11 is generally rectangularly shaped. The head portion 14 inclused a pocket portion 16 formed by peripherally seaming sheet 15 to the upper end 19 of the sheet 11.

The construction details of the creation of the pillow pocket 16 are clearly illustrated and emphasized in FIGS. 2, 4 and 5. Sheet 15 is initially hemmed along its bottom edge 20 to present a tough and durable edge 20 in the formation and use of the pillow pocket 16. The sides 21 of the hemmed portion forming the edge 20 are cut on a bias to allow the outside edges 22 to be easily sewn and terminated as further described herein afterwards. The outside edges 22 are each folded along lines A and B to form an accordian fold, generally indicated at 23, to allow the main body of the sheet 15 forming the pillow pocket 16 to be upwardly expandable so as to permit a pillow to be placed therein.

Similarly, the top edge 24 of sheet 15, as clearly illustrated in FIG. 2, is folded along lines C and D to form a third accordian fold, generally indicated at 25.

Subsequently, the outside edges 22 and the top edge 24 are seamed together with the peripheral edge 27 of the base portion 12 of the sheet 11 as respectively illustrated in FIG. 4. The corners 28 are seamed as shown in FIG. 5.

The pillow pocket 16 thus formed permits a pillow (not shown) to be slipped thereinto to sanitarily protect it when the person using the sleeping bag 10 places his head thereupon. Preferrably speaking, the entrance or opening to the pocket 14 should face the intermediate base portion 12 of the sleeping bag 10 to permit the person to place his hand under the pillow while sleeping or resting. This is a favorite sleeping or resting position of many people.

The cover portion 13 of sheet 11 has a pair of edge portions 29 which extend beyond the corresponding edges 30 of base portion 12 so that when the cover portion 13 is placed over and upon person using the sleeping bag, the sides of the body will remain covered. Without the edge portions 29, the sides of the body of the sleeping bag user will be uncovered; a highly undesirable feature.

Piping 31 is utilized quite extensively in the construction of the sleeping bag 10 both for esthetic reasons and prevent the edge, of the sheets about which it is wrapped, from fraying or unraveling and, also, to reduce wear thereof.

Arranged diagonally across each of the corners 28 on the underside of the base portion 12 of sheet 11 are stretch tapes 32 which allow the sleeping bag assembly 10 to be removably secured to the corresponding corners 33 of the mattress 34 shown in phantom in FIG. 1.

While I have illustrated and described the preferred form of construction for carrying the invention into effect, it is, nevertheless, capable of variation and modification without departing from the spirit and scope of the invention. I, therefore, do not wish to be limited to the precise details of the invention disclosed herein, but desire to avail myself of such variations and modifications as fall within the scope of the claims appended hereto.

What I claim is:

1. A sleeping bag, comprising:

(a) a base portion;

(b) a cover portion, the cover portion having a foot section substantially coextensive with the corresponding base portion thereunder, the foot section having a pair of sides joined along the edges thereof to the corresponding edges of the base portion and the balance of the cover portion having a pair of sides, the edge portions of which extend substantially beyond the corresponding pair of edge portions of the base portion, so that when a person's body is disposed between the cover portion and the base portion the edge portions of the cover portion still extend beyond the edge portions of the base portion; and (c) a head portion having a pocket for containing a pillow therein.

2. The sleeping bag construction of claim 1 wherein the pocket of the head portion has an accordian fold along each of the edges joined to the base portion to allow the pocket to be upwardly extensible to permit containment of a pillow therein.

3. The sleeping bag construction of claim 2 wherein the foot portion has an accordian fold along the edge joined to the base portion to allow the foot portion to be expandable to loosely contain the feet of the user of the sleeping bag.

4. The sleeping bag construction of claim 3 wherein the outside corners of the head portion having a pocket for containing a pillow therein are seamed together with the base portion.

5. The sleeping bag construction of claim 4 wherein all the corners thereof are radiused.

6. The sleeping bag construction of claim 5 wherein the peripheral edge of the base portion is rimmed with a piping strip.

7. The sleeping bag construction of claim 6 wherein said foot section having a pair of sides is joined along the edges of the base portion for only ten to twenty percent of the length of the base portion.

* * * * *